US006951257B2

(12) United States Patent
Comacchio et al.

(10) Patent No.: US 6,951,257 B2
(45) Date of Patent: Oct. 4, 2005

(54) DRILLING MAST WITH MOVABLE AND FIXED UNSCREWING VICE

(75) Inventors: Patrizio Comacchio, Riese Pio (IT); Pasqualino Comacchio, Riese Pio (IT); Renzo Comacchio, Riese Pio (IT)

(73) Assignee: Comacchio S.r.l., Reise Pio X (TV) (IT)

( * ) Notice: Subject to any disclaimer, the term of this patent is extended or adjusted under 35 U.S.C. 154(b) by 45 days.

(21) Appl. No.: 10/470,442

(22) PCT Filed: Dec. 5, 2001

(86) PCT No.: PCT/IT01/00616

§ 371 (c)(1),
(2), (4) Date: Jul. 28, 2003

(87) PCT Pub. No.: WO03/048502

PCT Pub. Date: Jun. 12, 2003

(65) Prior Publication Data

US 2004/0055789 A1 Mar. 25, 2004

(51) Int. Cl.[7] ..... E21B 19/16
(52) U.S. Cl. ..... 175/52; 175/162; 173/185
(58) Field of Search ..... 175/52, 85, 162; 173/185, 28, 39, 44

(56) References Cited

U.S. PATENT DOCUMENTS

| | | | | | |
|---|---|---|---|---|---|
| 4,403,666 | A | * | 9/1983 | Willis | 175/85 |
| 4,703,811 | A | * | 11/1987 | Lam | 173/28 |
| 4,821,814 | A | * | 4/1989 | Willis et al. | 173/164 |
| 5,575,344 | A | * | 11/1996 | Wireman | 175/85 |
| 6,138,776 | A | * | 10/2000 | Hart et al. | 175/85 |
| 2002/0157870 | A1 | * | 10/2002 | Bischel et al. | 175/52 |
| 2003/0056986 | A1 | * | 3/2003 | De Lille | 175/52 |

FOREIGN PATENT DOCUMENTS

| | | |
|---|---|---|
| EP | 0 379 187 A | 7/1990 |
| FR | 2 610 363 A | 8/1988 |
| FR | 2 625 239 A | 6/1989 |

* cited by examiner

*Primary Examiner*—William Neuder
(74) *Attorney, Agent, or Firm*—Egbert Law Offices

(57) ABSTRACT

The invention is a new drill for making micropiles, equipped with a mast on which the head-carrying trolley slides and having at the bottom of the mast two pairs of vices, a lower fixed vice and a upper unscrewing vice. Besides being able to rotate around the drilling axis, the unscrewing vice is able to move along said mast with respect to the lower fixed vice. The advantages are considerable, since it is no longer necessary to dismantle the rod and the covering during the extraction stages.

2 Claims, 3 Drawing Sheets

DRILLING MAST WITH MOVABLE AND FIXED UNSCREWING VICE

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present patent concerns drills for making steel and/or reinforced concrete micropiles and in particular it concerns a new drill with a translating extractor trolley for the drilling rod and the restraining covering.

BACKGROUND OF THE INVENTION

To consolidate the soil, or to make foundation piles near structures, or to make anchoring tie rods, and in other similar cases, micropiles are used which are made of steel or of concrete cast in holes made in the ground with suitable equipment.

Making micropiles by casting concrete into the ground contemplates the drilling of the ground with a drilling rod accompanied by a cylindrical covering.

At the end of the drilling rod there is a tool driven by air or by water under pressure.

The outer covering holds back the soil around the hole until the moment of the casting and allows the extraction of the material removed by the tool of the drilling rod during the drilling operation.

The drilling rod and the outer covering are driven into the soil simultaneously. At the end of the drilling operation the drilling rod is extracted, the pile or reinforcement and the concrete are introduced in the covering which is extracted gradually so as to allow the concrete to be perfectly compacted in the hole left by the covering.

Both the drilling rod and the covering are composed of various modular elements which are joined together, usually by screwing, until the necessary drilling length is obtained.

To make micropiles by casting concrete into the ground with a rod and covering, drills are used that are equipped with a mast (or guide or slide) that may be turned in various directions, on which a trolley with a drilling head slides, the drilling rod and/or the covering being applied on said trolley.

At the bottom end of the mast there is a group of vices comprising two pairs of jaws, called bottom vice and top vice, the latter being also called unscrewing vice, overlapping each other and concentric with the path of the trolley, the drilling rod and the covering.

In particular, the top pair of jaws rotates with respect to the mast. In this way the bottom jaws hold the rod or the covering already inserted while the rotating top jaws release the rod and/or covering elements next to them.

These drills permit the creation of holes for micropiles with a drilling rod and covering, but they present a series of inconvenient aspects.

The extraction of the drilling rod and of the covering is entrusted to the head-carrying trolley, which consequently must resist high stress. The advance movement of the head-carrying trolley is ensured by jacks, cables, chains, etc.

The screwing and unscrewing of the modular elements of the drilling rod and of the covering are possible only when the joining point is exactly between the two vices or pairs of jaws, where it is difficult for the operator to determine, both during drilling and during extraction the exact point in which to stop the trolley so that the joining point is exactly between said two vices.

At present for the standard version it is necessary to perform in sequence the operations described below for each element:

1. extract the rod for one module (~1.5 m) checking that the joining point is between the two sets of jaws;
2. block both vices and turn the upper unscrewing device;
3. disengage the unscrewing device, rotate the module by turning the head;
4. engage the unscrewing device on the module and disengage the head at the top;
5. unscrew the rod from the head and put away the rod;
6. move the head downwards until it screws onto the still semi-fixed module.

All these operations must obviously be repeated until the drilling device (rod) is completely extracted.

Moreover, these operations must also be performed for the covering.

The studies, stratagems and solutions adopted until now have not led to any acceptable result, sometimes even aggravating the situation.

BRIEF SUMMARY OF THE INVENTION

To overcome all the inconveniences described above a new type of drill has been designed and implemented for making micropiles with relative shifting of the unscrewing vice with respect to the bottom vice.

The aim of the new drill is to provide a mechanism for extracting the drilling rod and the covering that is independent of the mechanism for the advance of the head-carrying trolley.

The characteristics of the new drill will be better explained by following description with reference to the drawings enclosed as an example without limitation.

DETAILED DESCRIPTION OF THE INVENTION

The new drill comprises a carriage (A), a motor assembly (M), multi-jointed arms (B), a mast (R), two vices (G1, G2), a trolley (C) with drilling head (T).

The carriage positions and transfers the new machine from/to the point of drilling and onto the transport trailer.

The motor assembly (M) generates the energy necessary for the operation of the whole drill.

The multi-jointed arms (B) are hinged together, onto the chassis of the drill and onto the mast (R) and they direct and position said mast (R) on the point of drilling.

The mast (R) supports the drilling trolley (C) and, at the bottom end, the two pairs of vices (G1, G2).

The two pairs of vices (G1, G2) at the end of the mast (R) overlap and are situated at the sides of the path of the trolley, of the drilling rod and of the covering.

In particular the lower vices (G1) perform the only closing and opening movement on the drilling rod and on the covering. The higher unscrewing vices (G2) rotate around the drilling axis and are moved along the mast (R) with respect to the lower vices (G1).

Figure 1:
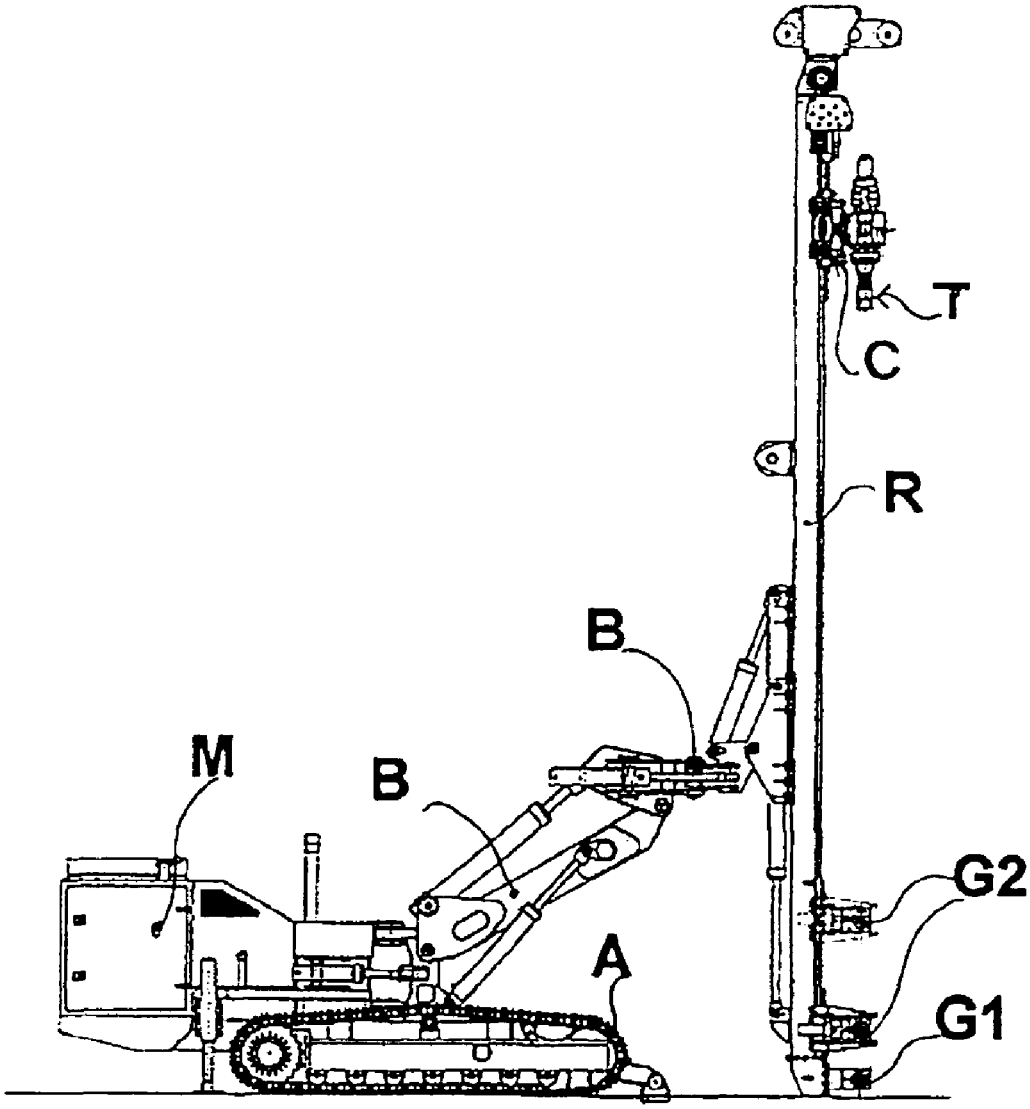
FIG. 1 is a side view of the new drill.
Figure 2:
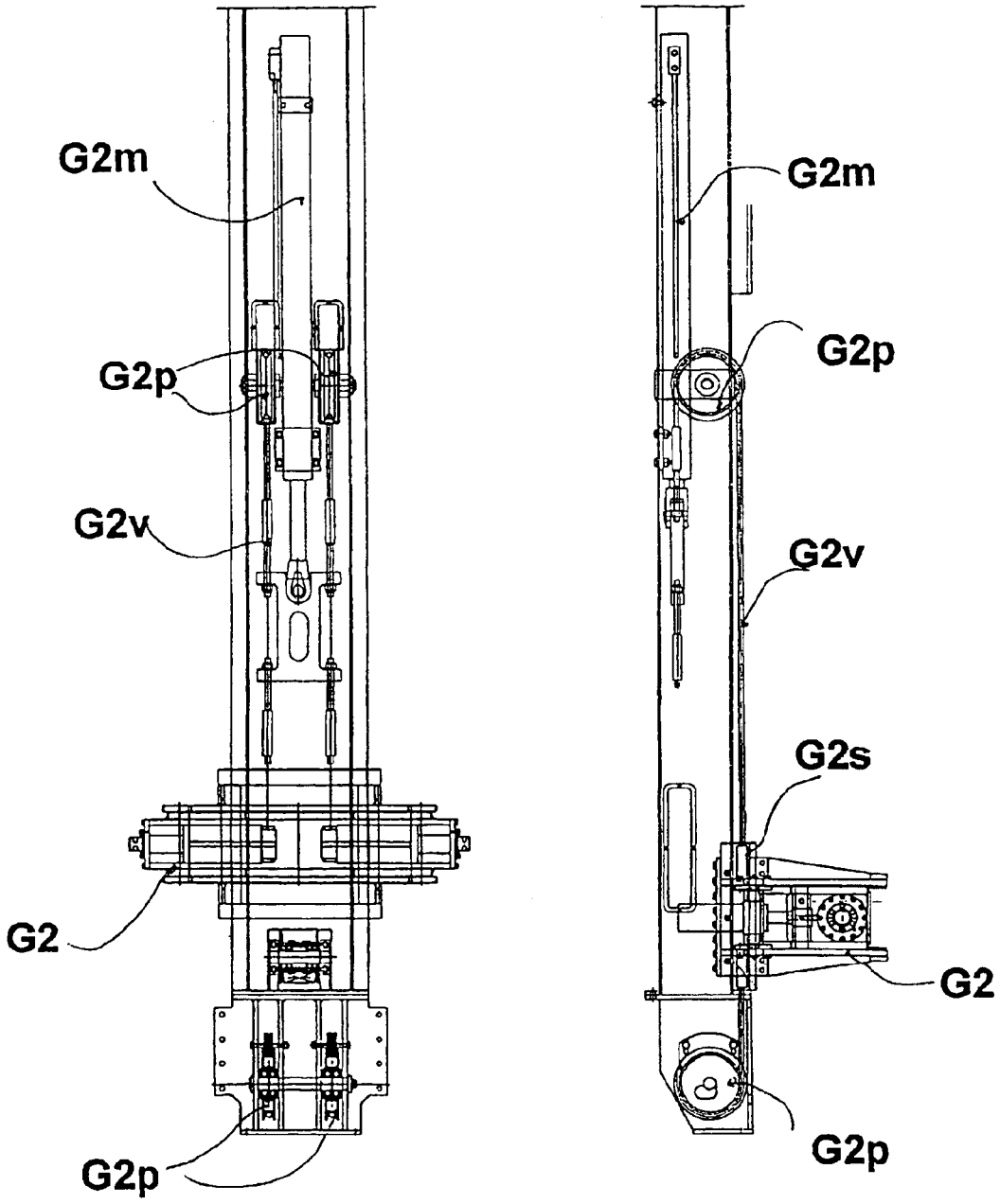
FIG. 2 shows a sectional view of the mast (R).

FIG. 2 shows a section of the mast (R) illustrating the movement of said upper vice (G2) with respect to the lower vice (G1).

The vice (G2) is mounted on a trolley of its own (G2*s*), which also slides on the mast (R) and is fixed to a pair of cables (G2*v*).

Said cables (G2*v*) are looped around two pairs of pulleys (G2*p*) and are connected to a hydraulic jack (G2*m*) parallel to the axis of said mast (R) and inside it. The new drill constituted as described above offers considerable advantages.

The extraction of the drilling rod and/or of the covering is entrusted to the second vice (G2).

The second vice (G2) grips the drilling rod or the covering and is rotated and moved upwards, taking it away from the first vice (G1).

Figure 3:
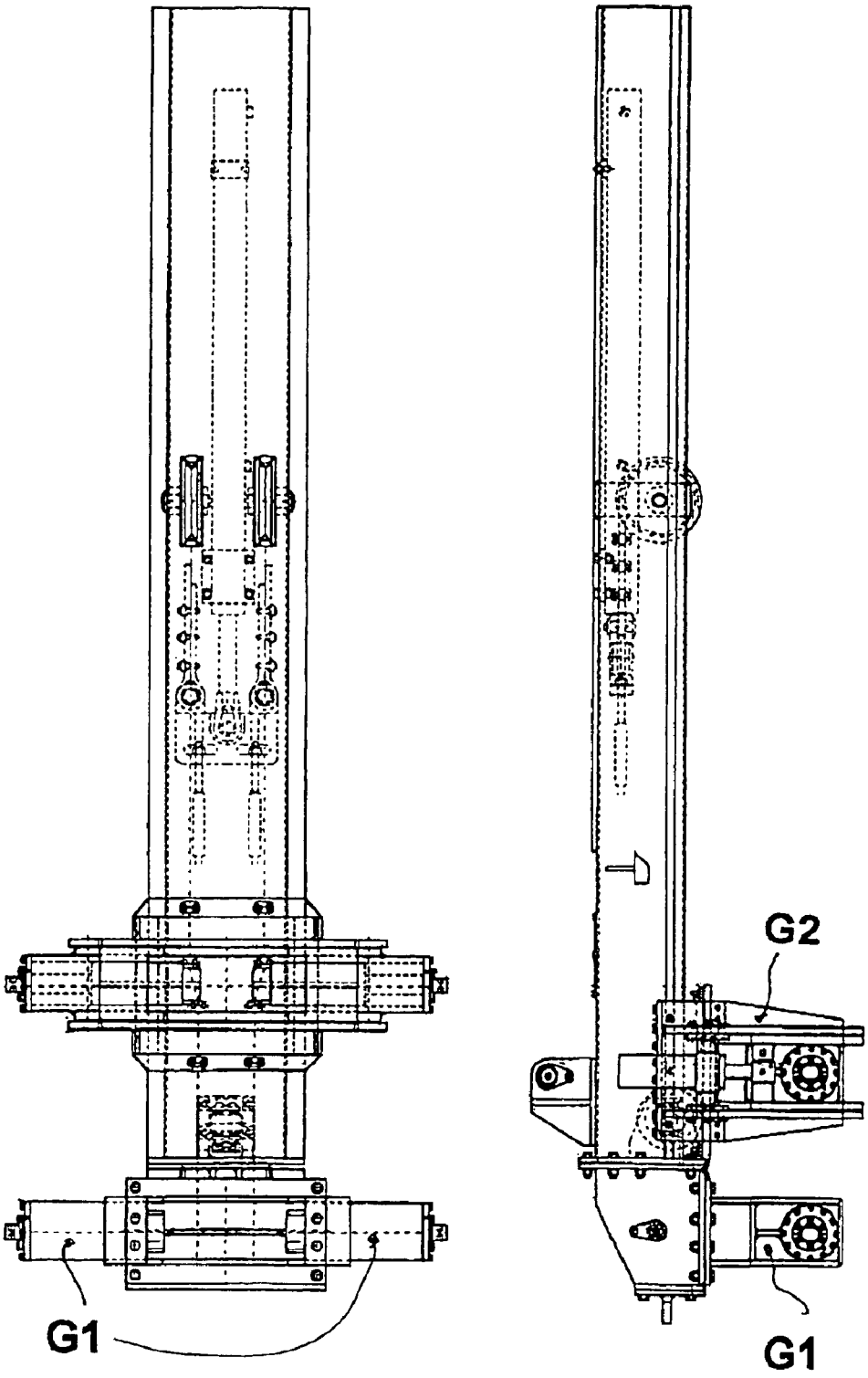
FIG. 3 is another sectional view of the mast with a first vice.

FIG. 3 shows the same mast (3) with the vice (G1) applied thereto.

This solution is particularly advantageous because the mobile upper vice is conceived to all effects as an extractor for both the rod and the covering.

As a result it is possible, for example, to extract the rod completely with the head and, while said rod remains on the (drilling) axis, to extract the covering with the upper vice (G2), reinserting the rod in it.

The advantages may be easily recognized, since with this system it is possible to proceed to make the next micropile without having to dismantle (unscrew and rescrew) the rod assembly or the covering.

Therefore, with reference to the above description and to enclosed drawings, the following claims are put forth.

We claim:

1. A drill for making micropiles comprising:

a mast;

a trolley means slidably mounted on said mast, said trolley means for carrying a drilling head thereon along a drilling axis;

a fixed vice positioned adjacent a lower end of said mast; and an unscrewing vice positioned above said fixed vice and translatably movable along said mast relative to said fixed vice, said unscrewing vice being rotatable about the drilling axis.

2. The drill of claim 1, further comprising:

a sliding trolley separate from said trolley means, said sliding trolley movably positioned on said mast, said unscrewing vice being affixed to said sliding trolley;

a hydraulic jack means affixed to said mast;

a pair of pulleys connected to said hydraulic jack means; and a pair of chains or cables connected at one end of said sliding trolley, the pair of chains or cables being looped respectively over said pair of pulleys, said pair of chains or cables being connected to said hydraulic jack means, said hydraulic jack means for controllably moving said sliding trolley along said mast.

* * * * *